US006585562B2

(12) United States Patent
Gitis et al.

(10) Patent No.: US 6,585,562 B2
(45) Date of Patent: Jul. 1, 2003

(54) METHOD AND APPARATUS FOR POLISHING CONTROL WITH SIGNAL PEAK ANALYSIS

(75) Inventors: Norm V. Gitis, Cupertino, CA (US); Michael A. Vinogradov-Nurenberg, Sunnyvale, CA (US)

(73) Assignee: Nevmet Corporation, Reno, NV (US)

( * ) Notice: Subject to any disclaimer, the term of this patent is extended or adjusted under 35 U.S.C. 154(b) by 44 days.

(21) Appl. No.: 09/953,756

(22) Filed: Sep. 17, 2001

(65) Prior Publication Data

US 2002/0173223 A1 Nov. 21, 2002

Related U.S. Application Data

(63) Continuation-in-part of application No. 09/859,062, filed on May 17, 2001.

(51) Int. Cl.[7] ..... B24B 49/00
(52) U.S. Cl. ..... 451/5; 451/8
(58) Field of Search ..... 451/5, 6, 8, 41, 451/285, 286, 287, 288, 398

(56) References Cited

U.S. PATENT DOCUMENTS 5,222,329 A 6/1993 Yu
5,245,794 A 9/1993 Salugsugan
5,439,551 A 8/1995 Meikle et al.
5,876,265 A 3/1999 Kojima
6,179,688 B1 * 1/2001 Beckage et al. ..... 451/6
6,257,953 B1 * 7/2001 Gitis et al. ..... 451/5
6,290,573 B1 * 9/2001 Suzuki ..... 451/8
6,424,137 B1 * 7/2002 Sampson ..... 324/76.21
6,494,765 B2 * 12/2002 Gitis et al. ..... 451/5

* cited by examiner

*Primary Examiner*—Dung Van Nguyen

(57) ABSTRACT

The apparatus for polishing control with signal peak analysis consists of two major units: a polishing machine and a polishing process control and monitoring system which has sensors for sensing changes on the surface and/or inside the object during polishing. In response to the above changes the sensors generate operating data signals. The control and monitoring system, which also contains a signal conditioning unit and a control unit, amplifies the operating data signals and sends them to a signal analyzer, which determines average values and peaks of the conditioned signals. The analyzer also determines a ratio of the peak signal values to an average signal values and compares the obtained ratio with a preliminarily determined reference value optimized with regard to the specific CMP process carried out on the polishing machine. When the measured signal ratio reflects abnormal conditions, polishing conditions are adjusted back to normal by means of a control signal generated on the basis of the aforementioned ratio. The apparatus of the invention also provides quantitative evaluation of changes in the CMP process and automatic control of the CMP process in a manner that optimizes the process and prevents occurrence of defects that might be caused by the controlled process.

29 Claims, 6 Drawing Sheets

METHOD AND APPARATUS FOR POLISHING CONTROL WITH SIGNAL PEAK ANALYSIS

REFERENCE TO RELATED CASES

The present patent application is a continuation-in-part application of U.S. patent application Ser. No. 09/859,062 filed on May 17, 2001, now pending.

FIELD OF THE INVENTION

The present invention relates to a method and apparatus for control of a polishing process based on a signal peak analysis, in particular to a method and apparatus for monitoring a polishing process, such as chemical mechanical polishing, in the manufacture of semiconductor wafers.

BACKGROUND OF THE INVENTION

Polishing processes play significant role in modern technologies, in particular in semiconductor fabrication. For example, at certain stages in the fabrication of devices on a substrate, it may become necessary to polish the surface of the substrate before further processing may be performed. In a polishing process, known as mechanical polishing, a polishing pad with abrasive particles repetitively passes over the surface of the substrate. Polishing may also be performed with chemically active abrasive slurry. A polishing system that uses the chemical slurry is commonly known as a chemical mechanical polishing (CMP) system. In contrast with mechanical polishing, the slurry in a CMP system provides an increased removal rate of a substrate material. Additionally, by selecting particular chemicals, chemical slurry can be used to selectively polish certain films on a semiconductor substrate.

Wafer polishing typically requires that a substrate be mounted in a wafer head or carrier, with the surface of the substrate to be polished exposed. The substrate supported by the head is then placed against a moving polishing pad mounted on a platen. The head holding the substrate may also move, e.g., rotate, to provide additional motion between the substrate and the polishing pad surface. In a CMP process, a polishing slurry (typically including abrasive particles and at least one chemically reactive agent, which is selected to enhance the polishing of the topmost film layer of the substrate) is supplied to the pad to provide an abrasive chemical solution at the interface between the pad and the substrate.

Both the CMP and traditional mechanical abrasion polishing are difficult to control. The CMP process is frequently carried out without comprehensive information about current polishing conditions, and its control is performed just by using empirical polishing rates and timing. Since such polishing control methods are inaccurate, the polishing process results in serious yield drops and waste of expensive wafers. Therefore, accurate control of polishing based on reliable real-time information is an important issue for automation of such processes.

One of known methods used to control polishing is based on measurements of sound waves or audible acoustic noise generated in the interface between the wafer and polishing material (e.g., three U.S. Pat. No. 5,222,329 issued on Jun. 29, 1993, U.S. Pat. No 5,245,794 issued on Sep. 21, 1993, and U.S. Pat. No. 5,439,551 issued on Aug. 8, 1995).

This control method is based on the fact that changes in the polishing process are accompanied by noticeable changes in the amplitude and spectrum of an acoustic signal.

The acoustic signals are detected with the use of an acoustic signal receiver, such as a microphone, located in the vicinity, but outside of the polishing zone of a wafer-pad contact. The signal is then recorded in a manner known in the art and used for a process analysis. This method, however, is limited to measuring low frequency signals, which reduces its sensitivity, and to monitoring their average characteristics, which does not allow for detection of local polishing defects such as delamination and scratches.

U.S. Pat. No. 5,876,265 issued on Mar. 2, 1999 to T. Kojima describes a polishing apparatus with end point detection based on analysis of acoustic signals involving peak detection. The polisher includes a vibration detecting device attached to a wafer carrier, an amplifier, a gain indicator with gain adjuster to adjust a gain of such amplifier, an end-point analyzer based on the change in said adjusted signal, and a controller to stop the polishing motion upon the end-point signal. The suitability of the amplifier gain and need for its adjustment is determined based on whether it's either amplitude or maximum value resides in a preset reference range. The gain indicator may include a peak detector for detecting peaks of signal waveform and making gain adjustments based on a peak signal output when a magnitude is not suitable. These method and apparatus, however, measure only low-frequency signals, which makes them less sensitive to changes in the polishing process. Also, they do not allow making a distinction between regular acoustic signals and those generated due to abnormal polishing effects, such as scratches and delamination.

Another example of polishing control based on detection of acoustic signals is disclosed in U.S. patent application Ser. No. 09/859,062 filed by the same applicants on May 17, 2001. The present patent application is a continuation-in-part of the aforementioned patent application.

The above patent application describes an apparatus for controlling a CMP process, comprising a rotating or orbiting platen with a pad, a rotating head that supports an object to be treated, e.g., a semiconductor wafer, and performs radial movements with respect to the platen, and a polishing process control system comprising a plurality of groups of various sensing devices for detecting changes that occur during polishing. One group of the sensing devices is a group of high-frequency acoustic emission sensors built on various levels into components of the rotating head. Another group of sensing devices is represented by force/torque sensors connected with various elements of the rotating head and the platen, respectively, and intended for direct measurement of compression force and friction response (force or torque) between the head and the platen and a coefficient of friction between the wafer and the polishing pad. All groups of sensors work simultaneously and their measurement data is processed and analyzed by a control unit for obtaining accurate and reliable results. The results are then used for adjusting the process.

One disadvantage of all known polishing control methods and apparatus is that they do not provide quantitative evaluation of changes in a polishing process in a manner required for optimization of the process and for preventing occurrence of defects that might be caused by the polishing process itself. Another disadvantage consists in that known polish control methods just establish the fact of occurrence of the changes and do not distinctly distinguish between regular peaks of signals and extraordinary peaks. Such extraordinary peaks may be caused by undesired events such as delamination of sublayers within a semiconductor wafer resulting, e.g., from an excessive normal force, with which the polishing pad is pressed to the surface of the wafer being treated.

OBJECTS OF THE INVENTION

It is an object of the present invention to provide a method and apparatus for polishing control with quantitative evaluation of changes in the polishing process. Another object is to provide a method and apparatus for automatic analysis of acoustic or other signals and for controlling the process in a manner that allows to optimize polishing conditions and thus to prevent occurrence of defects during polishing. Another object is to provide a method and apparatus capable of separating extraordinary signal peaks from regular signal peaks.

SUMMARY OF THE INVENTION

The apparatus of the invention for polishing control with signal peak analysis consists of two major units: a polishing machine and a polishing process control and monitoring system. The polishing machine may be a CMP machine for polishing semiconductor wafers, which has a moving polishing pad and a rotating object-holding means such as a polishing head that supports an object to be treated. The control and monitoring system contains sensors for sensing changes on the surface and/or inside the object during polishing and for generating operating data signals in response to these changes. The control and monitoring system also contains a signal conditioning unit for processing the operating data signals and a control unit for generating a control signal for controlling a drive of the polishing machine. The signal conditioning unit amplifies the operating data signals and sends them to a signal analyzer, which determines both average values and peaks of the conditioned signals, as well as a ratio of the peak signal values to the average signal values. The signal analyzer also compares the obtained ratio and signal values with preliminarily determined reference values optimized with regard to the specific polishing process carried out on the polishing machine. When the measured signal ratio reflects abnormal conditions, polishing conditions are adjusted to normal by means of a control signal generated in the control unit. The apparatus of the invention also provides quantitative evaluation of changes in the CMP process and automatic control of the CMP process in a manner that optimizes the process and prevents occurrence of defects that might be caused by the controlled process.

DETAILED DESCRIPTION OF THE INVENTION

Figure 1:
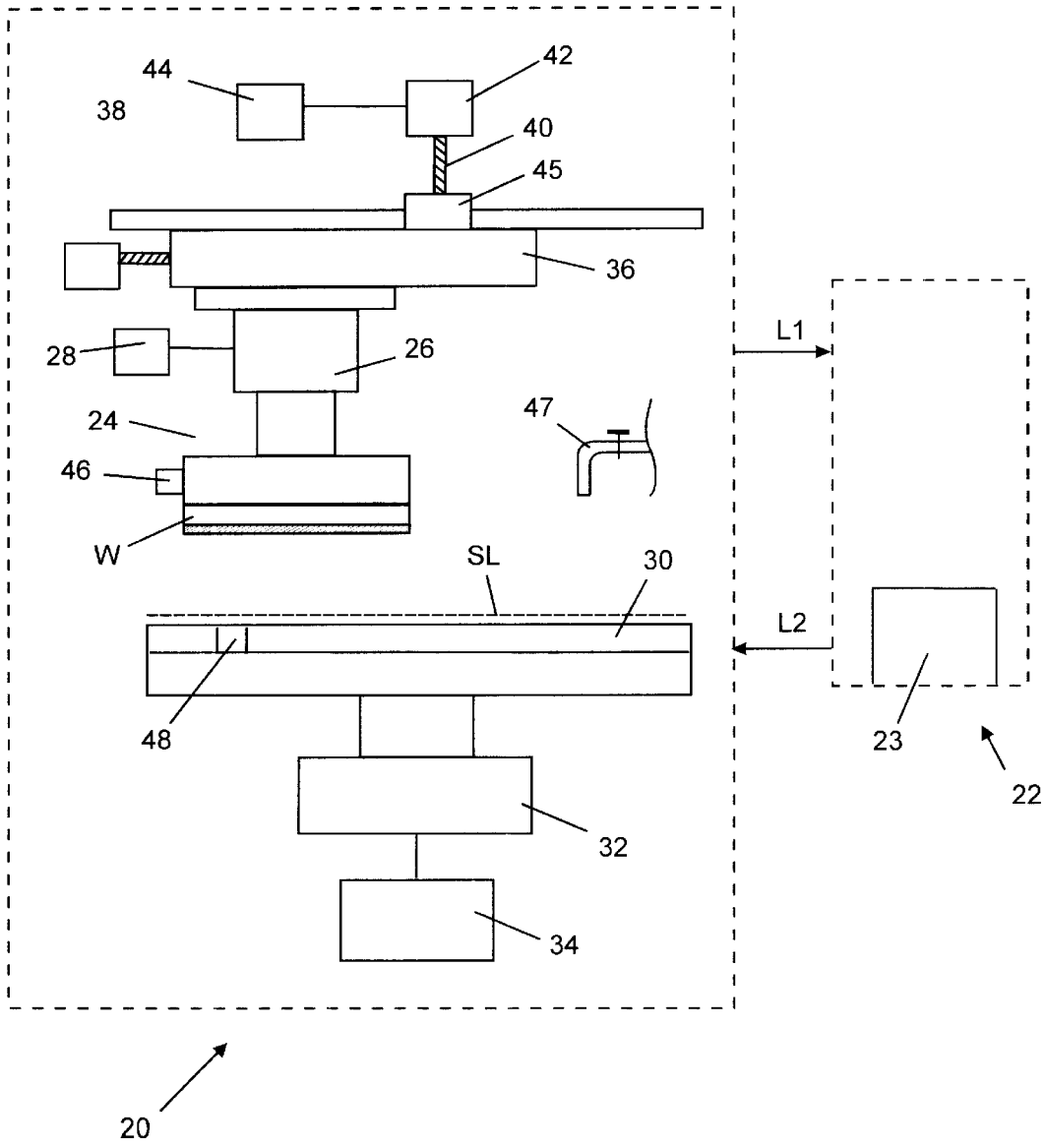
FIG. 1 is a general schematic view of the apparatus of the invention for polishing control with signal peak analysis.

A general schematic view of the apparatus of the invention for polishing control with signal peak analysis is shown in FIG. 1. The apparatus consists of a polishing machine 20, e.g., a CMP machine intended for polishing a semiconductor wafer W, and a control and monitoring system, which in FIG. 1 is shown in the form of a single box 22. The control and monitoring system contains a control unit 23, which may be, e.g., a stand-along controller, a computer, or the like. The polishing machine 20 and the control and monitoring system 22 are interconnected via a data line L1 and a feedback line L2.

The polishing machine 20 may have a configuration different from the one shown in FIG. 1, and the CMP machine shown in FIG. 1 may have different arrangement. In any case, however, the CMP machine has an object-holding means, e.g., a polishing head 24 which supports an object to be polished, such as a semiconductor wafer W, and may be driven into rotation, e.g., by an electric motor 26 with a power source 28.

The polishing machine has a polishing tool such as a polishing pad 30, which in the illustrated embodiment is located under the polishing head 24 and has a diameter greater than that of the object being treated. The polishing pad 30 is driven into rotation, e.g., by an electric motor 32 connected to a power source 34. In different arrangements, the polishing pad 30 may perform an orbital or linear motion. Also, the polishing head 24 may perform a linear reciprocating motion; in the embodiment shown in FIG. 1 this motion is performed with the use of a carriage 36 that slides in guides 38.

A force with which the semiconductor wafer W is pressed against the polishing pad 30 is provided by means of a vertical loading mechanism shown in the form of a lead screw 40 driven into rotation by a motor 42 with a power supply 44. The lead screw 40 engages a nut 45 secured to the carriage 36. In different arrangements, the loading mechanism can include a hydraulic or air cylinder either instead of or in addition to the lead screw.

To this point, the above description related to a conventional CMP machine. A part of the control system is also known and consists of sensors and measuring devices described in aforementioned U.S. patent application Ser. No. 09/859,062. More specifically, reference numerals 46 and 48 designate electroacoustic sensors, e.g., piezoelectric transducers, embedded into different components of the polishing head 24 or polishing pad 30. In the context of the present invention the term "electroacoustic sensor" means any sensor that converts either contact acoustic emission signals, or mechanical waves (vibrations) of both high and low frequency, or contact electrical impedance or capacitance or resistance into electric signals. In the apparatus of the invention these sensors detect contact acoustic emission generated by interactions between the contacting surfaces of the polishing pad 30 and the semiconductor wafer W and convert it into electroacoustic data signals AE.

Figure 2:
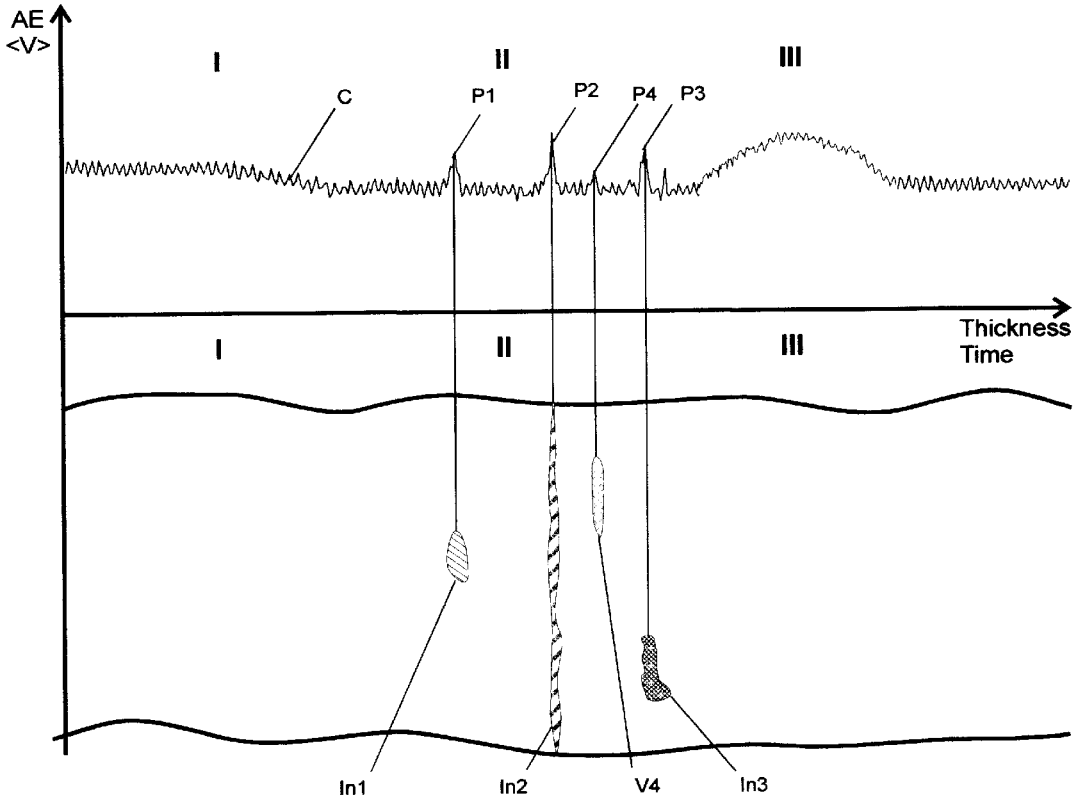
FIG. 2 is an example of registration of electroacoustic signals obtained during polishing of a laminated structure consisting of layers with different physical properties.

FIG. 2 is an example of registration of electroacoustic signals obtained during polishing of a laminated structure consisting of layers I, II and III of materials with different physical properties. For convenience of presentation the layers I, II and III are shown under the graph aligned with its respective portions. The graph shown in FIG. 2 illustrates variation of the electroacoustic signal AE (the ordinate axis) with polishing time (the abscissa axis). The abscissa axis also reflects the thickness of the object being polished, since the layers I, II and III are polished out sequentially in time.

It has been found experimentally that polishing of a homogeneous material generates acoustic signals of certain regular amplitude with an extended acoustic spectrum. An RMS (root mean square) value of such an electroacoustic signal is represented by a layer 1, which has very small peaks of amplitude. A drop of the signal level on the portion C of the electroacoustic signal curve of FIG. 2 corresponds to a transition from layer I to layer II. It can be assumed that the layer II consists of an acoustically softer material (for example, with the Hook constant lower than that in the layer I). The high positive peaks P1, P2 and P3 on the section of the graph corresponding to the layer II may be caused, e.g., by hard inclusions In1, In2, and In3 in the material of the layer II, while the low peak P4 may be caused, e.g., by a void V4 or by local delamination of the material in the layer II. The upwardly concave curve on the portion of the graph corresponding to the layer III may lead to an assumption that this last layer has non-uniformity in either hardness or material removal.

The above example shows that defects of different physical nature can be reflected on the changes in the spectrum of signals. This is true not only for electroacoustic signals but for other electric signals, e.g. resulting from measuring electrical resistance or capacitance in contact between the polishing pad and the wafer during polishing.

It is understood that defects in the semiconductor wafer can be of two types: inherent defects pre-existing in the material or on the surfaces of the layers (inclusions, voids, etc.) and process defects that occur during polishing and caused by the polishing (scratches, cracks, delaminations, etc.). The term "changes in the object" covers changes both on the surface of the object and in its inner material.

The applicants have found that the average value of an electroacoustic signal represents the intensity of surface interaction between the polishing pad 30 and the object being treated, e.g., the wafer W. In particular, the average electroacoustic signal generated by an electroacoustic sensor during polishing represents intensity of polishing and the rate of material removal. On the other hand, irregular peaks in an electroacoustic signal and the amplitude of these peaks, such as peaks P1, P2, P3, and P4 shown in FIG. 2, represent abnormalities in the polishing process. Examples of such abnormalities are aforementioned delaminations, voids, micro-scratches, chipping, flaking, inclusions, micro-cracks, etc.

Figure 3:
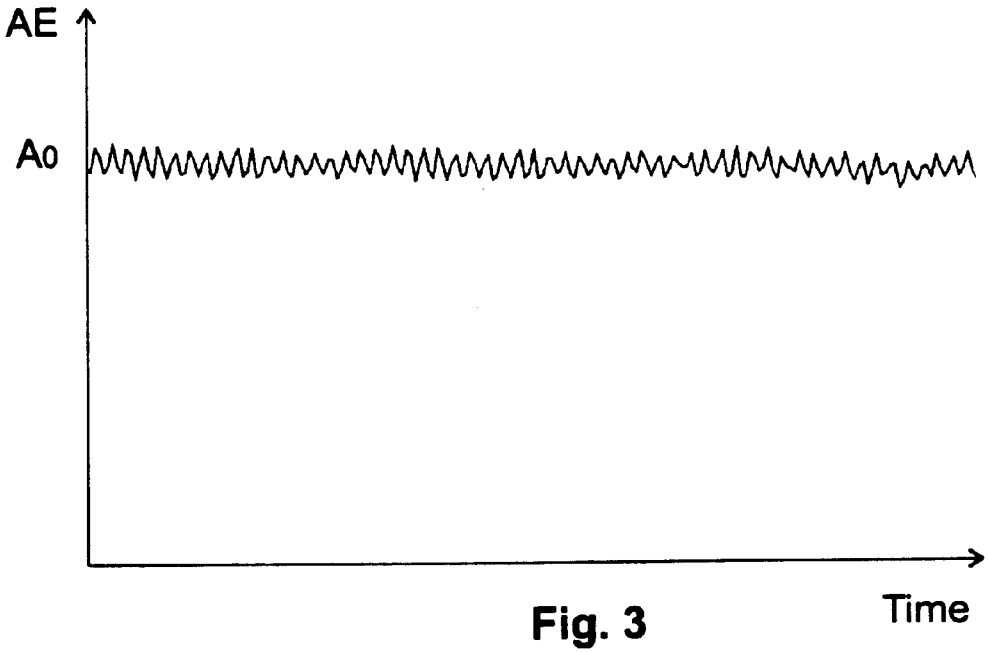
FIGS. 3 and 4 are graphs illustrating electroacoustic signals registered under different polishing conditions.
Figure 4:
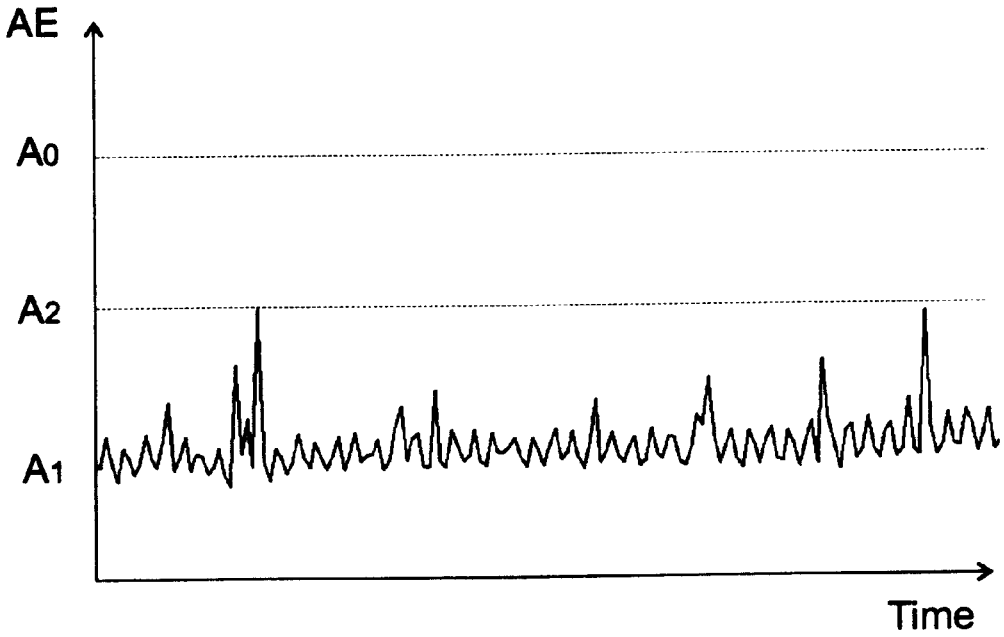

The applicants have found that an absolute value of the aforementioned peaks in the electroacoustic signal alone is not a sufficient criterion for characterization of a polishing process. Indeed, in some cases even at a relatively high average level A0, the electroacoustic signal does not have peaks. This case is shown in FIG. 3, where the ordinate axis corresponds to the amplitude of the electroacoustic signal. Such a condition would testify to the fact that polishing is carried out with high intensity, but without abnormalities. On the other hand, cases are possible when, as shown in FIG. 4, the average level of electroacoustic signals A1 is lower than the average level of the acoustic signal A0 of the case shown in FIG. 3, but the peaks are present and have the maximum amplitude A2, which can be lower than A0. Thus, the case of FIG. 3 may be considered acceptable, while the case of FIG. 4 may be considered unacceptable, even though the maximum level of the electroacoustic signal is lower than the absolute value of the average signal of the acceptable case.

Based on these considerations and on the results of multiple experiments, the applicants came to a conclusion that it would be more appropriate to monitor and control a polishing process by using a ratio of the maximum peak value of an acoustic signal to an average value of this signal as a criterion of the polishing process quality.

For realization of the aforementioned method the applicants have developed the control and monitoring system 22 shown schematically in FIG. 1 in the form of a single block. The aforementioned threshold of optimized values is used as an input data loaded into this system. The system 22 of the apparatus of the invention is shown in more detail in FIG. 5. It contains aforementioned electroacoustic sensors 46 and 48, generating electroacoustic signals S1 and S2, respectively, connected to inputs of respective wide-band amplifiers 50 and 52, both intended for preliminary amplification of the electroacoustic signals. Outputs of wide-band amplifiers 50 and 52 may be connected to inputs of respective signal filters 54 and 56, such as high-pass or band-pass filters. The filters may have amplifiers 58 and 60 for amplification of the filtered signals. The filtered signals are added in an adding unit 62, based, e.g., on an operational amplifier, and the resulting signal is then sent to an RMS converter 64. Such a converter is a standard unit commercially produced, e.g., by Analog Devices, Inc. (Norwood, Mass.). The RMS converter converts the resulting filtered high-frequency signal S3 into a low-frequency RMS signal S4, representing an average intensity of the electroacoustic signal.

Figure 5:
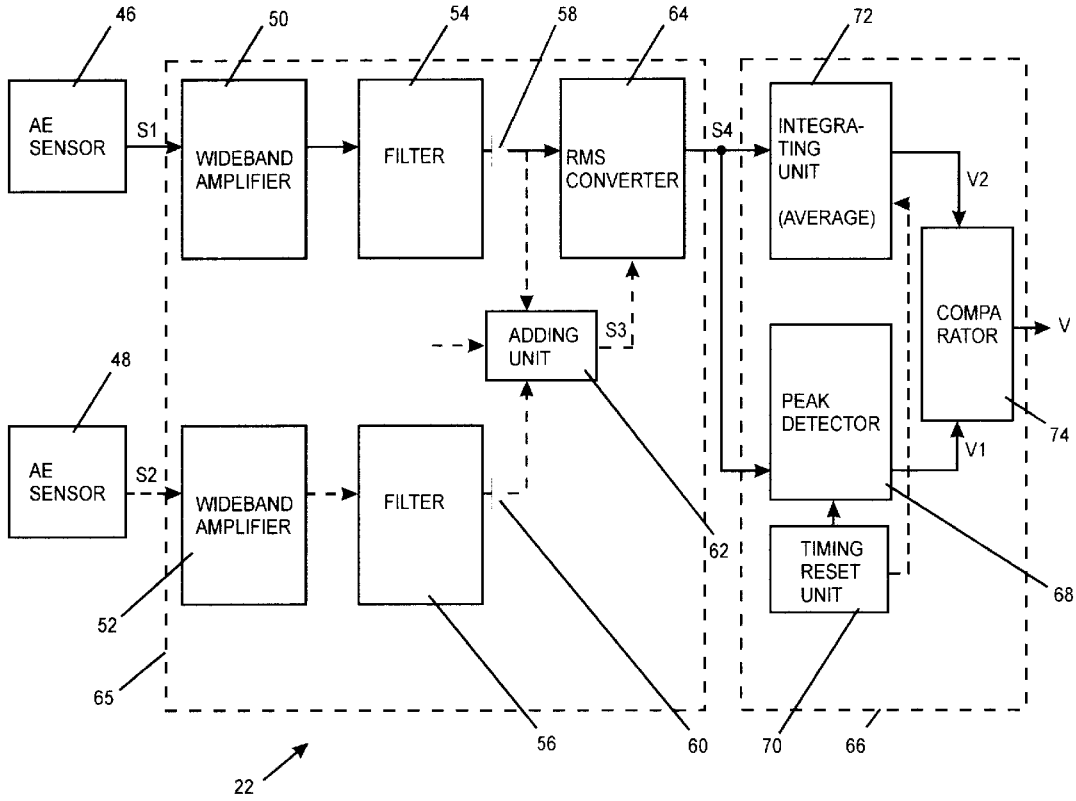
FIG. 5 is a block diagram of a control and monitoring system of the apparatus of the invention.

For simplification of the drawings, two of such sensors 46 and 48 are shown in FIGS. 1 and 5. It is understood, however, that either one or more than two electroacoustic sensors may be used. If, for example, only one electroacoustic sensor 46 is used in the system with the respective wide-band amplifier 50, filter 54, and amplifier 58, then the adding unit 62 is not needed.

Until now, the description was related to a known part of the control and monitoring system 22, similar to the one described in the aforementioned U.S. Pat. No. 5,245,794, which in the following description will be referred to as a signal conditioning unit 65 (FIG. 5).

The distinguishing part of the control and monitoring system 22 of the invention is shown on the right side of FIG. 5 in the form of a signal analyzer 66 (dotted line). The signal analyzer 66 measures all aforementioned parameters of the electroacoustic signal, such as the average value, the maximum peak value, and the ratio of the maximum peak value to the average value. More specifically, the signal analyzer 66 contains a peak detector 68 with a timing reset unit 70. The peak detector 68 is connected to the output of the RMS converter 64 and generates a peak signal V1 (FIG. 5). The signal analyzer 66 further contains an integrating unit 72, which is also connected to the output of the RMS converter 64 and generates an average-value signal V2; and a comparator 74 for generating a measured ratio signal V proportional to a ratio of the maximum peak value V1 to the average value V2 of the electroacoustic signal. The respective inputs of the comparator 74 are connected to the outputs of the peak detector 68 and of the integrating unit 72.

Figure 6:
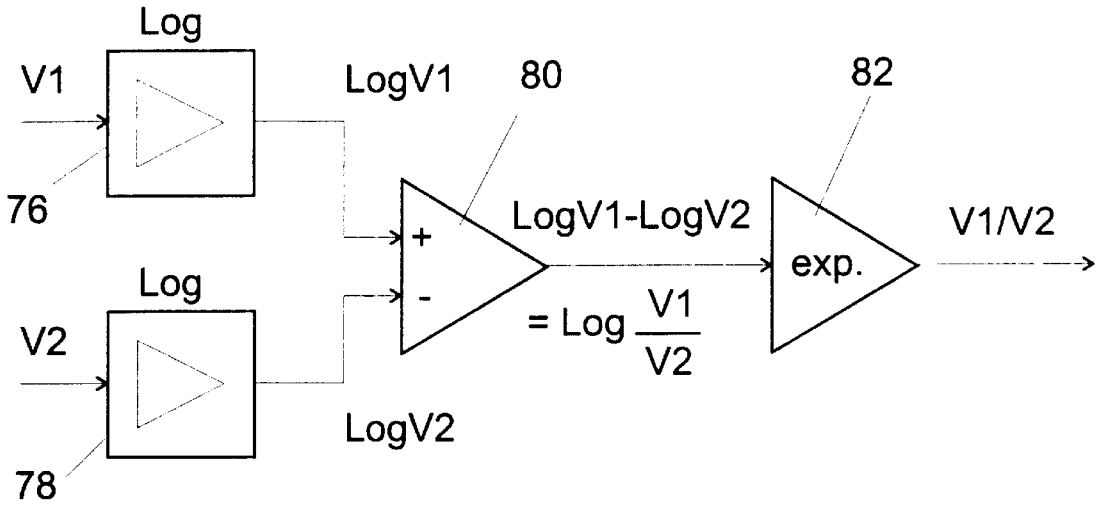
FIG. 6 is an example of a block diagram of a comparator suitable for use in the control and monitoring system of the invention.

An example of a comparator 74 is shown schematically in FIG. 6, where reference numerals 76 and 78 designate logarithmic amplifiers, 80 designates a subtracting unit which subtracts one input signal from another, and 82 designates an exponential amplifier for generating a signal of a measured ratio of the aforementioned signals V1 to V2.

The apparatus of the invention operates as follows.

A semiconductor wafer W with multiple layers, the outermost of which has to be polished, is attached to the polishing head 24 so that it faces a polishing pad 30. The control and monitoring system 22 is activated, the polishing head 24 with the wafer W and the polishing pad 30 are brought into rotation from respective electric motors 26 and 32 connected to power sources 28 and 34. The polishing head 24 is then fed towards the polishing pad 30 by means of the loading mechanism formed by the lead screw 40 with the nut 45 attached to the carriage 36. The lead screw 40 is driven from the motor 42, which is fed from the power supply 44. As a result, the semiconductor wafer W comes into contact with the polishing pad 30 with a predetermined contact pressure. Simultaneously with rotation, the polishing head 24 may perform linear oscillating motions in the radial direction of the pad 30 by means of the carriage 36, moveable in the guides 38.

The surface of the polishing pad 30 is being covered with polishing slurry SL, supplied to the polishing surface of the pad from a slurry supply system 47. It is known to a person skilled in the art that the properties of the slurry and the flow rate of the slurry supply may affect the results of polishing and, therefore, shall be controlled during polishing.

Figure 7:
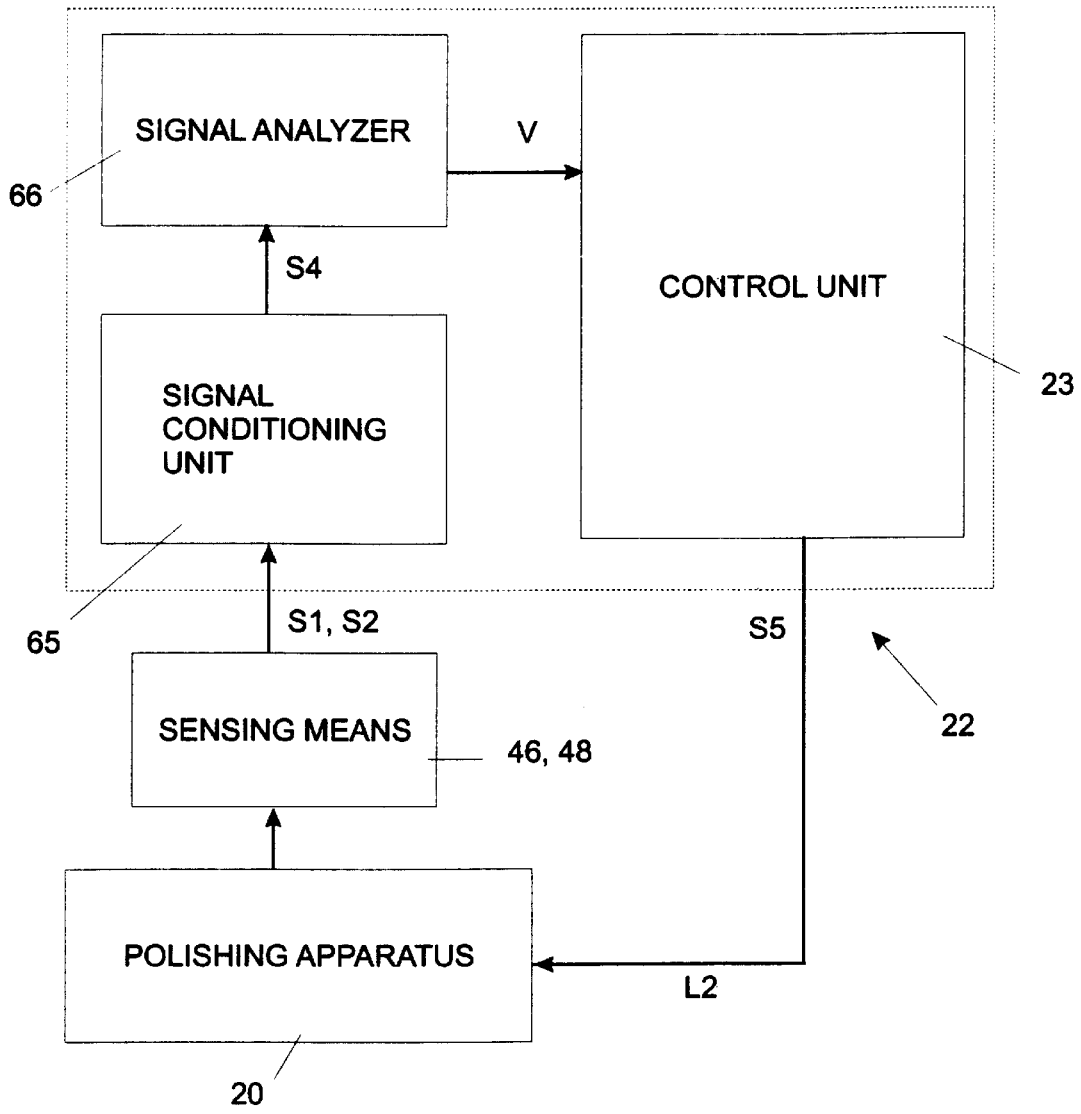
FIG. 7 is a flowchart of signals used for control of the polishing in the apparatus of the invention.

The polishing process is accompanied by high-frequency contact acoustic emission, generated in the interface of the contacting surfaces of the semiconductor wafer W and the polishing pad 30. The emission reflects the changes in the object during polishing and is detected as electroacoustic signals by electroacoustic sensors 46 and 48 built into the polishing head 24 and/or polishing pad 30. The sensors 46 and 48 generate on their outputs operating electroacoustic data signals S1 and S2, respectively. These signals may be of the type shown in FIGS. 2–4 and correspond to intensity of the polishing process. FIG. 7 is a flowchart of signals used for control of the polishing process in the apparatus of the invention. The operating electroacoustic data signals S1 and S2 (FIGS. 5 and 7) are sent to respective wideband amplifiers 50 and 52 and then to respective filters 54 and 56, which may be of high-pass or band-pass types. These filters cut off low-frequency components, which correspond to mechanical, electrical, and environmental noise and vibrations. In other words, only high-frequency acoustic components of a desirable bandwidth pass through the filters. After amplification in amplifiers 58 and 60, the signals are summarized in the adding unit 62, and the resulting signal 83 is sent to the RMS converter 64. In the case of a single acoustic sensor, the amplified signal is sent directly from the amplifier to the RMS converter. The RMS converter 64 generates a conditioned signal S4 (FIG. 5 and FIG. 7), which is sent as an input signal to the signal analyzer 66. The use of the RMS converter is optional, and after amplification the resulting signal S3 can be sent directly to the signal analyzer 66.

As mentioned above, the electroacoustic signals may have high-amplitude random peaks of the type shown in FIGS. 2 and 4, reflecting abnormalities of the polishing process. Examples of such abnormalities are defects in the material being treated, such as aforementioned delaminations, voids, micro-scratches, chipping, flaking, inclusions, micro-cracks, etc.

The function of the signal analyzer 66 is to detect such abnormalities and to generate a ratio signal V for controlling the operation of drive motors 26, 32, and 42 of the polishing machine 20 and the slurry supply system 47. More specifically, the motor 42 controls contact pressure between the wafer W and the polishing pad 30, while the motors 26 and 32 control rotation of the polishing head 24 and of the polishing pad 30, respectively.

In the signal analyzer 66, signal S4 is supplied to both the peak detector 68 and the integrating unit 72. The peak detector 68 generates a signal V1, which corresponds to the maximum amplitude of the peak of the conditioned electroacoustic signal S4, while the integrating unit 72 generates a signal V2, which corresponds to the average level of the same signal S4. The peak detector 68 and the integrating unit 72 may be connected to the timing reset unit 70, which synchronizes operation of the aforementioned devices 68 and 72.

Signals V1 and V2 are sent to the inputs of the comparator 74 which, in turn, generates the aforementioned ratio signal V used by the control unit 23 for controlling operation of the polishing machine 20. The control unit 23 compares the ratio signal V with an optimized reference value, stored, e.g., in a memory (not shown) of the control unit 23, and generates a control signal S5 (FIG. 7). The control signal S5 is sent via the feedback line L2 to the polishing machine, i.e., to motors 26, 32, 42, and the slurry supply system 47.

When a polishing process is stable, which corresponds to the acoustic signal without high peaks (FIG. 3), the ratio of the maximum peak amplitude to the average value of the electroacoustic signal is about 1, and the ratio signal V has a low level.

When, however, a polishing process is accompanied by abnormalities characterized by the presence of high peaks, as shown in FIG. 4, the aforementioned ratio of the maximum peak amplitude to the average value of the electroacoustic signal significantly exceeds 1, and the ratio signal V has a high level. The difference in the levels of the aforementioned ratio signal V can be used for controlling, via a feedback control signal S5 (FIG. 7), the operation of actuating units of the polishing machine 20, for automatically adjusting parameters of the polishing process to eliminate abnormalities.

Thus, it has been shown that the method and apparatus of the invention provide polishing control with signal peak analysis and quantitative evaluation of changes and defects in the polishing, e.g. CMP, process. The apparatus is capable of separating the extraordinary signal peaks from regular or random signal peaks. The method and apparatus provide automatic monitoring and control of a polishing process in a manner that optimizes the process and prevents occurrence of surface defects that may be caused by polishing.

Although the invention has been shown and described with reference to specific practical examples, it is understood that these examples were given only for illustration purposes and that any other changes and modifications, including various combinations of the parts and units of the invention, are possible provided that these changes and modifications do not depart from the scope of the appended claims.

For example, the comparator of the signal analyzer can be embodied in different forms known in the art. Although in the embodiment illustrated in the description of the invention both the head and the pad perform rotational motions, they may perform orbital or linear movements. The operation of the apparatus was illustrated with two signals S1 and S2 on the outputs of the sensors 46 and 48; however, only one such signal or more than two signals can be generated by one or by many electroacoustic sensors, respectively. The integrating unit 72 can be made in the form of a low-pass filter, an analog integrator, or as a part of control software. The peak detector 68 and the comparator 74 also can be embodied as a part of the control software.

What is claimed is:

1. An apparatus for polishing control with signal peak analysis comprising:

a polishing machine comprising a polishing tool, a polishing tool drive means for driving said polishing tool, and an object-holding means for holding an object to be treated;

sensing means for sensing changes in said object, said sensing means generating operating data signals in response to said changes;

a signal control and monitoring system for processing said operating data signals and for generating a control signal for controlling said polishing machine, said signal control and monitoring system comprising:

a signal conditioning unit having signal amplifying means for amplifying said operating data signal and a conditioned signal generation means for generating conditioned signals;

a signal analyzer comprising: means for determining average values of said conditioned signals, means for determining peak values of said conditioned signals, and means for generating a measured ratio signal proportional to a ratio of said peak signals to said average signals; and a control unit having an input connected to said analyzer and means for generating said control signal.

2. The apparatus of claim 1, further comprising a feedback line that connects said means for generating said control signal with said polishing tool drive means.

3. The apparatus of claim 2, wherein said sensing means comprises at least one electroacoustic sensor.

4. The apparatus of claim 3, wherein said at least one electroacoustic sensor is built into a device selected from said polishing tool and said object-holding means.

5. The apparatus of claim 4, wherein said conditioned signal generation means comprises a root-mean-square AC-to-DC converter.

6. The apparatus of claim 1, wherein said polishing machine is a chemical mechanical polishing machine, said polishing tool is a polishing pad, and said object-holding means is a polishing head of said chemical mechanical polishing machine.

7. The apparatus of claim 6, wherein said sensing means comprises at least one electroacoustic sensor.

8. The apparatus of claim 7, wherein said at least one electroacoustic sensor is built into a device selected from said polishing head and said polishing pad.

9. The apparatus of claim 6, wherein said conditioned signal generation means comprises a root-mean-square AC-to-DC converter.

10. The apparatus of claim 1, wherein said conditioned signal generation means comprises a root-mean-square AC-to-DC converter.

11. An apparatus for control of a chemical mechanical polishing process with signal peak analysis comprising:

a chemical mechanical polishing machine comprising a polishing pad, a polishing pad drive means for driving said polishing pad, a polishing head for holding an object to be treated, a polishing head drive means, loading means for creating contact pressure between said object and said polishing pad, and polishing slurry supply means;

electroacoustic sensing means for sensing changes in said object, said electroacoustic sensing means having an output that generates operating data signals in response to said changes;

a signal control and monitoring system for processing said operating data signals and for generating a control signal, comprising: a signal conditioning unit having an input connected to said output of said electroacoustic sensing means, said signal conditioning unit generating a conditioned signal; a signal analyzer connected to said signal conditioning unit; and a control unit having an input connected to said signal analyzer and an output connected to said chemical mechanical polishing machine;

said signal analyzer comprises: an integrating unit for generating an average level of said conditioned signal, said integrating unit having an input and output, said input of said integrating unit being connected to said signal conditioning unit; a peak detector having an input and output, said input of said peak detector being connected to said signal conditioning unit; and a comparator having an output, a first input connected to said output of said integrating unit, and a second input connected to said output of said peak detector, said output of said comparator being connected to said control unit.

12. The apparatus of claim 11, further comprising a feedback line that connects said signal control and monitoring system to said chemical mechanical polishing machine for sending said control signal to at least one of said polishing pad drive means, said polishing head drive means, said loading means, and said polishing slurry supply means for automatically performing said polishing control.

13. The apparatus of claim 12, wherein said electroacoustic sensing means comprises at least one electroacoustic sensor.

14. The apparatus of claim 13, wherein said at least one electroacoustic sensor is built into a device selected from said polishing pad and said polishing head.

15. The apparatus of claim 14 wherein said polishing head drive means comprises at least a rotary drive means for rotating said polishing head and a vertical feed mechanism for bringing said object in contact with said polishing pad during polishing.

16. The apparatus of claim 15, wherein said signal conditioning unit comprises at least one wide-band amplifier connected to said output of said at least one electroacoustic sensing means and a root-mean-square AC-to-DC converter having an input connected to said wide-band amplifier and an output connected to said signal analyzer.

17. The apparatus of claim 16, further comprising a filter between said wide-band amplifier and said root-mean-square AC-to-DC converter, said filter being selected from the group consisting of a high-pass filter and a band-pass filter.

18. The apparatus of claim 11, wherein said polishing head drive means comprises at least a rotary drive means for rotating said polishing head and a vertical feed mechanism for bringing said object in contact with said polishing pad during polishing.

19. The apparatus of claim 11, wherein said signal conditioning unit comprises at least one wide-band amplifier connected to said output of said at least one electroacoustic sensing means and a root-mean-square AC-to-DC converter having an input connected to said wide-band amplifier and an output connected to said signal analyzer.

20. The apparatus of claim 19, further comprising a filter between said wide-band amplifier and said root-mean-square AC-to-DC converter, said filter being selected from the group consisting of a high-pass filter and a band-pass filter.

21. A method for polishing control with signal peak analysis comprising the steps of:

providing a polishing machine for polishing an object, fixed in a polishing head, with the use of a polishing tool, said polishing machine having means for moving said polishing tool, means for moving said polishing head together with said object, loading means for creating contact pressure between said object and said polishing tool, and polishing slurry supply means, said polishing machine being equipped with sensing means and with a control and monitoring system connected to said polishing machine via a feedback line;

initiating an operation of polishing said object with said polishing tool while maintaining said polishing head and said polishing tool in contact and moving at least one of said polishing head and said polishing tool for creating a relative motion;

detecting by said sensing means acoustic waves generated in said contact between said object and said polishing tool and generating operating electroacoustic data signals by said sensing means in response to said acoustic waves, said operating electroacoustic data signals corresponding to intensity of said operation of polishing;

processing said operating electroacoustic data signals in said control and monitoring system for obtaining conditioned signals;

detecting and analyzing peaks of said operating electroacoustic data signals;

determining a peak level and an average level of said operating electroacoustic data signals;

determining a ratio of said peak level to said average level for generating a ratio signal;

generating a control signal based on said ratio signal and said average level; and sending said control signal to said polishing machine via said feedback line for controlling said operation of polishing.

22. The method of claim 21, wherein said sensing means comprises at least one electroacoustic sensor built into a device selected from said polishing tool and said object-holding means.

23. The method of claim 22, wherein said polishing machine is a chemical mechanical polishing machine, said polishing tool is a polishing pad.

24. The method of claim 23, wherein said step of processing said operating electroacoustic data signals in said control and monitoring system for obtaining conditioned signals comprises passing said operating electroacoustic data signals sequentially through a wide-band amplifier and a root-mean-square AC-to-DC converter, said conditioned signals having peaks.

25. The method of claim 24, further comprising a step of passing said operating electroacoustic data signals through a filter selected from a group consisting of a high-pass filter and a band-pass filter installed between said wide-band amplifier and said root-mean-square AC-to-DC converter.

26. The method of claim 24, wherein said step of determining said ratio comprises: providing said control and monitoring system with a signal analyzer comprising an integrating unit, a peak detector, and a comparator; sending said conditioned signals to said peak detector for generating a peak level signal that corresponds to the maximum amplitude of said peaks of said conditioned signals; sending said conditioned signals to said integrating unit for generating an average level signal that corresponds to the average level of said conditioned signals; and sending said peak level signal and said average level signal to said comparator for obtaining said ratio signal.

27. The method of claim 21, wherein said controlling said operation of polishing comprises sending said control signal via said feedback line to at least one of said means for moving said polishing tool, said means for moving said polishing head, said loading means for creating contact pressure between said object and said polishing tool, and said polishing slurry supply means.

28. The method of claim 21, further comprising the steps of: detecting abnormalities in said operation of polishing by detecting and analyzing said peaks of said operating electroacoustic data signals; and sending said control signal to said polishing machine for eliminating said abnormalities.

29. The method of claim 28, wherein said abnormalities are selected from a group consisting of delaminations, voids, microscratches, chipping, flaking, inclusions, and microcracks in said object.

* * * * *